US005964534A

United States Patent [19]

Welles

[11] Patent Number: 5,964,534

[45] Date of Patent: Oct. 12, 1999

[54] BAG FOR EDIBLE FOOD PRODUCT

[76] Inventor: Theodore W. Welles, 32485 Creekside Dr., Pepper Pike, Ohio 44124

[21] Appl. No.: 09/255,145

[22] Filed: Feb. 22, 1999

Related U.S. Application Data

[63] Continuation-in-part of application No. 08/901,483, Jul. 28, 1997, abandoned.

[51] Int. Cl.[6] ..... B65D 33/00

[52] U.S. Cl. ..... 383/66; 229/87.08; 229/938; 383/207; 383/211; 426/115

[58] Field of Search ..... 383/66, 207, 208, 383/210, 211; 229/938, 87.08; 426/115, 122

[56] References Cited

U.S. PATENT DOCUMENTS

| | | | |
|---|---|---|---|
| 391,022 | 10/1888 | Cliett | 383/66 |
| 1,329,466 | 2/1920 | Miller . | |
| 1,463,002 | 7/1923 | Bernstein | 383/66 |
| 1,628,429 | 5/1927 | Radford . | |
| 1,869,313 | 7/1932 | Mackay | 229/87.08 |
| 1,970,848 | 8/1934 | Grant . | |
| 2,027,791 | 1/1936 | Schrager . | |
| 2,189,174 | 2/1940 | Hohl . | |
| 2,306,335 | 12/1942 | Feigenbutz . | |
| 2,318,735 | 5/1943 | Bickford | 383/66 |
| 2,653,744 | 9/1953 | Behr . | |
| 2,816,700 | 12/1957 | Doyle | 383/66 |
| 2,897,863 | 8/1959 | Somers, Jr. | 383/66 |
| 2,923,456 | 2/1960 | Ryan . | |
| 3,143,153 | 8/1964 | Smith . | |
| 3,276,669 | 10/1966 | Vilutis . | |
| 3,478,868 | 11/1969 | Nerenberg et al. . | |
| 3,570,751 | 3/1971 | Trewella | 383/207 |
| 3,663,239 | 5/1972 | Rowe et al. | 426/122 |
| 3,945,415 | 3/1976 | February . | |
| 4,245,449 | 1/1981 | Nelham | 426/115 |
| 4,292,332 | 9/1981 | McHam . | |
| 4,579,278 | 4/1986 | Altus | 229/87.08 |
| 4,608,259 | 8/1986 | Cortopassi . | |
| 4,618,992 | 10/1986 | LaGrotteria . | |
| 4,697,732 | 10/1987 | Altus | 229/87.08 |
| 4,723,700 | 2/1988 | Wischusen, III . | |
| 4,777,054 | 10/1988 | Greenhouse . | |
| 4,917,247 | 4/1990 | Jud . | |
| 5,094,863 | 3/1992 | Vandenburg . | |
| 5,335,996 | 8/1994 | Cortopassi et al. . | |
| 5,399,366 | 3/1995 | Geddes et al. . | |
| 5,464,285 | 11/1995 | Anderson . | |
| 5,503,477 | 4/1996 | Schlough | 229/938 |
| 5,507,579 | 4/1996 | Sorenson . | |
| 5,722,774 | 3/1998 | Hartz . | |

FOREIGN PATENT DOCUMENTS

| | | | |
|---|---|---|---|
| 22641 | 5/1935 | Australia | 229/87.08 |
| 2462351 | 2/1981 | France . | |
| 1804423 | 5/1970 | Germany . | |

*Primary Examiner*—Stephen P. Garbe
*Attorney, Agent, or Firm*—Vickers, Daniels & Young

[57] ABSTRACT

A bag of flexible material for packaging an edible food product and supporting the food product for eating has a closed bottom and an open top for receiving a food product. A wall of the bag is adapted to be opened between the top end and a location spaced above the bottom end of the bag, whereby a closed pouch is formed below the location by which a consumer can hold the food product and wherein the portion of the bag above the location is foldable outwardly about the pouch to provide a skirt covering the consumer's hand.

27 Claims, 3 Drawing Sheets

BAG FOR EDIBLE FOOD PRODUCT

This application is a continuation-in-part of application Ser. No. 08/901,483 filed Jul. 28, 1997, now abandoned and incorporated herein by reference.

BACKGROUND OF THE INVENTION

This invention relates to the art of bags and, more particularly, to a bag for packaging an edible food product and supporting the food product for eating.

It is of course well known that the primary packaging procedure with regard to sandwiches such as hamburgers, for example, in connection with a carry-out food service is to wrap the sandwich in a paper wrapper and to put the wrapped sandwich into a bag by which the customer carries the sandwich to a table or the like at which the customer sits and eats the sandwich. Often, the wrapper is removed and spread on the table and the sandwich is held by hand, whereby grease, mustard, ketchup, or other liquids on and in the sandwich drip onto the paper wrapper and/or onto the customer's hands. Sometimes, in an effort to avoid such dripping, the consumer will attempt to partially enclose the hamburger in the paper wrap. However, since the latter is basically a square, flat sheet of paper, manipulation thereof in an effort to relocate or expose portions of the hamburger to facilitate eating thereof results in the liquids leaking from the wrapper and, often, onto the hands and perhaps down the arms of the consumer.

Numerous bag constructions have been provided heretofore for the purpose of packaging products including food products and which bags are designed to facilitate access to the contents thereof. A number of such bag constructions are intended to be initially stapled, glued or otherwise sealed against access to the interior thereof and are provided with tear strips, rip cords and the like for accessing the interior. Such constructions are shown, for example, in U.S. Pat. No. 2,306,335 to Feigenbutz, U.S. Pat. No. 2,923,456 to Ryan and U.S. Pat. No. 5,094,863 to Vandenburg. The bags in the patents to Feigenbutz and Ryan are adapted to be sealed at the opposite ends thereof and are provided with tear strips which extend across a side panel of the bag and thence across both of the sealed ends thereof, whereby the bag is, in effect, longitudinally slit by pulling the tear strip from one sealed end across the other. In Vandenburg, the rip cord is provided in the sealed seam at one end of the bag or about the circumference of the bag intermediate the opposite ends thereof. In the latter construction, pulling on the rip cord separates the package into two pieces or, alternatively, into horizontally connected pouches. In either event, a pouch is provided for holding a food product to be eaten. Other bag constructions provided for packaging edible food products include a side panel which is severable from the remainder of the bag between open and closed ends thereof and extendable from the closed end so as to provide a tray on which the food products can be supported while being eaten. Such constructions are shown, for example, in U.S. Pat. No. 4,618,992 to Grotteria, U.S. Pat. No. 5,335,996 to Cortopassi, et al. and U.S. Pat. No. 5,399,366 to Geddes, et al. Another construction in the form of a folded wrapper for holding a food product such as a taco while it is being eaten is disclosed in U.S. Pat. No. 4,608,259 to Cortopassi.

SUMMARY OF THE INVENTION

In accordance with the present invention, a bag for packaging an edible food product and supporting the food product for eating is provided which advantageously minimizes or overcomes the problems and disadvantages encountered in connection with such packaging arrangements heretofore available. More particularly in accordance with the present invention, a bag is provided of a size to enclose an edible food product, such as a hamburger, so as to optimize retention of the temperature thereof and retention of liquids associated with the sandwich against leakage during transportation of the sandwich to a point of consumption. At the time of consumption, the bag is adapted to be readily converted to a closed pouch for holding the food product in a manner which precludes the dripping of liquids therefrom and enables the consumer to hold the sandwich without getting grease or other liquids on his or her hands. Preferably, such a bag in accordance with the present invention is constructed from a flexible material, such as a waxed kraft paper, and has an open upper end for receiving a sandwich. The upper end is adapted to be folded to enclose the sandwich therein for transportation either in the bag alone or in a larger bag with other food items. At the point of consumption, the upper end of the bag is unfolded and the bag is openable between the open upper end and a location spaced above the bottom of the bag, whereby the lower end of the bag forms a closed pouch in which the hamburger is cradled and exposed for eating. The wall of the bag between the upper end thereof and the location of the lower end of the opening is foldable outwardly and downwardly to form a skirt extending about the pouch. In accordance with one aspect of the invention, a line of severance is provided, such as by perforations or a peelable seam, to facilitate the ease of tearing and opening of the bag along a straight line. In accordance with another aspect of the invention, portions of an overlapping seam are joined at the top end of the bag and left unjoined therebelow to the location spaced above the bottom of the bag, thus facilitating the ease of use of the bag by eliminating the need to tear the material thereof In any event, the consumer holds the sandwich through the pouch portion of the bag, and the skirt portion extends downwardly about the fingers of the consumer. The pouch catches grease and other liquids which exude from the sandwich during eating, and the skirt further protects against the spillage of liquids, pieces of lettuce or the like associated with the hamburger onto the consumer's hands. Further advantage resides in the fact that if the hamburger or other sandwich is not completely consumed, the bag can be folded back to its original contour with the uneaten portion of the hamburger remaining in the pouch, and the hamburger is covered by wrapping or folding the upper wall portion of the bag downwardly about the bottom of the bag.

It is accordingly an outstanding object of the present invention to provide an improved bag for packaging an edible food product and for supporting the food product for eating.

Another object is the provision of a bag which enables the packaging of an edible food product and the subsequent eating of the food product using the bag as a support therefor in a manner which improves protection for the consumer against the drippage of liquids, food and other materials from the package during consumption of the food product.

Still another object is the provision of a bag of the foregoing character having a closed end and an open end for receiving a food product which can be packaged therein by folding the open end to a closed condition and which, upon reopening, can be transformed to provide a pouch in which the food product is supported and by which the latter is held in the hand of a consumer for eating, and a skirt portion extending outwardly and about the pouch for protecting the hand of the consumer from spillage of liquids or other materials from the food product.

A further object is the provision of a bag of the foregoing character having open and closed ends and a denoted line of severance or entry in a wall thereof extending from the open end to a location spaced from the bottom end, whereby the wall can be opened to provide a pouch adjacent the bottom of the bag and the portion of the wall above the opening can be folded to form a skirt extending outwardly and downwardly about the pouch.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which:

FIG. 8 is a perspective view of the bag with the bottom end closed; and,

FIG. 9 is an enlarged sectional elevation view of the bag taken along line 9—9 in FIG. 8.

DESCRIPTION OF PREFERRED EMBODIMENTS

Figure 1:
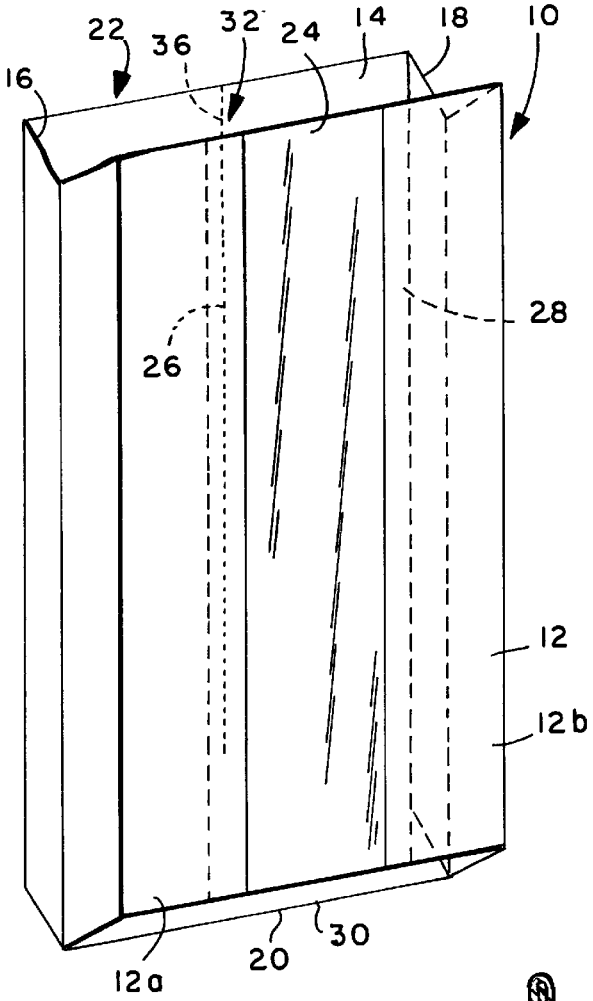
FIG. 1 is a front perspective view of a bag in accordance with the present invention.

Referring now in greater detail to the drawings wherein the showings are for the purpose of illustrating preferred embodiments of the invention only, and not for the purpose of limiting the invention, a bag 10 is illustrated in FIGS. 1–5 which comprises a front wall 12, a rear wall 14, pleated side walls 16 and 18, a closed bottom 20, and an open top 22. In the embodiment illustrated in the latter figures, front wall 12 includes side portions 12*a* and 12*b*, and the latter together with rear wall 14 and side walls 16 and 18 are preferably of a waxed kraft paper. Side portions 12*a* and 12*b* of the front wall are laterally spaced apart, and front wall 12 further includes an intermediate panel 24 of a transparent plastic film material such as polyethylene, polypropylene or the like which is adhesively bonded to side portions 12*a* and 12*b* along seam areas 26 and 28 therebetween, respectively. It will be appreciated that the bag as thus far described can be produced by continuously forming craft paper and transparent plastic film into a tubular configuration with the film bonded to the paper, folding and flattening the tube to provide the pleated side walls, cutting the flattened tube into desired lengths, and folding and adhesively bonding a portion of one end of the flattened tube in overlying relationship with the adjacent portion of the tube to provide the closed end of the bag. The latter fold can be a single or multiple fold and, in any event, provides a relatively narrow end flap 30 which, in this embodiment, is folded to overlie and is adhesively bonded to front wall 12 of the bag. Transparent panel 24 provides a window which advantageously enables the consumer to see the food product in the bag, but it will be appreciated that the bag could be constructed in its entirety from opaque paper material having a single longitudinal seam and which, otherwise, is basically manufactured in the foregoing manner. Further, while it is preferred to use a waxed kraft or other paper for the bag material to optimize the retention of liquids and juices from the food product within the bag, it will be appreciated that the bag can be made from an unwaxed kraft or other paper or from other liquid repellant materials. Still further, it will be appreciated that other bag structures can be used such as, for example, a flat bag having no pleated side walls, or a bag having pleated sides and a flat bottom wall.

In accordance with the present invention, a bag of flexible material having an open top and a closed bottom includes an arrangement for providing an opening through a wall of the bag between the top end thereof and a location spaced from the bottom of the bag, whereby the bottom portion of the bag when so opened provides a pouch or pocket for supporting a food product in the bag for eating. Further in accordance with the invention, the portion of the bag above the pouch is foldable outwardly thereabout to expose the food product and to provide a skirt extending outwardly and downwardly about the pouch. Accordingly, a consumer can grasp the food product by way of the pouch, and the skirt covers the consumers hand whereby, while the consumer is eating the product, any liquids, juices or the like exuding from the food product are retained in the pouch and thus do not spill or drip onto the consumer's hand. Moreover, any liquids, juices or other food particles which may separate from the food product while it is being consumed are deflected by the skirt into the pouch and/or outwardly therefrom and, in either event, away from contact with the consumer's hand.

Figure 2:
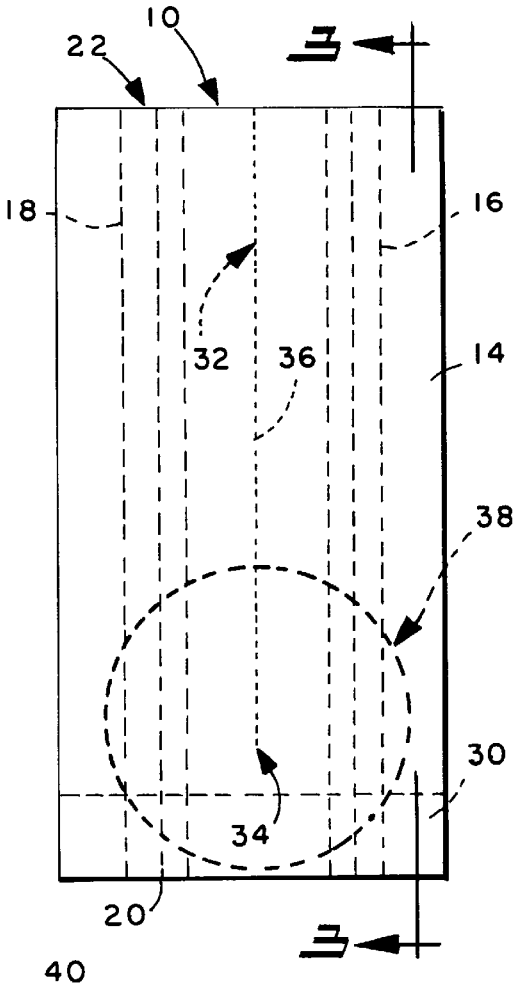
FIG. 2 is a rear elevation view of the bag shown in FIG. 1 and showing a food product therein in phantom.
Figure 3:
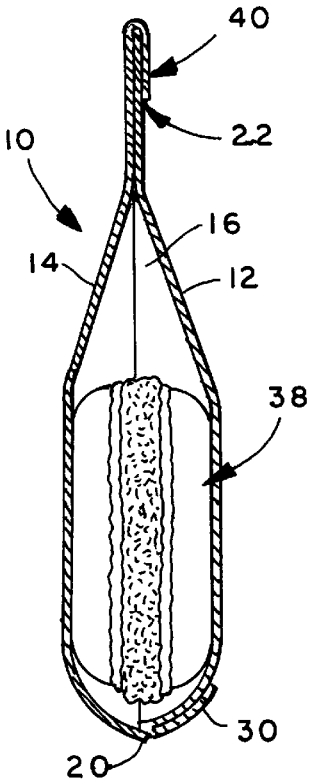
FIG. 3 is a sectional elevation view of the bag taken along line 3—3 in FIG. 2.
Figure 4:
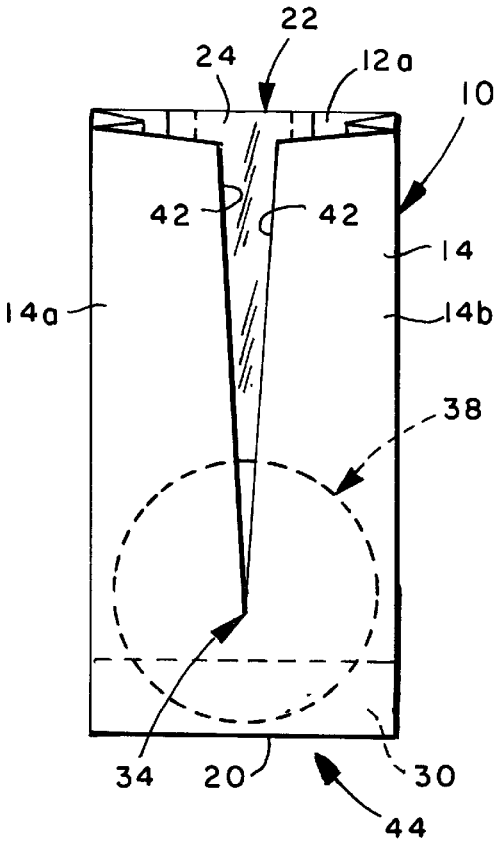
FIG. 4 is a rear elevation view of the bag similar to FIG. 2 and illustrating the bag severed along a line of weakness in a wall thereof.
Figure 5:
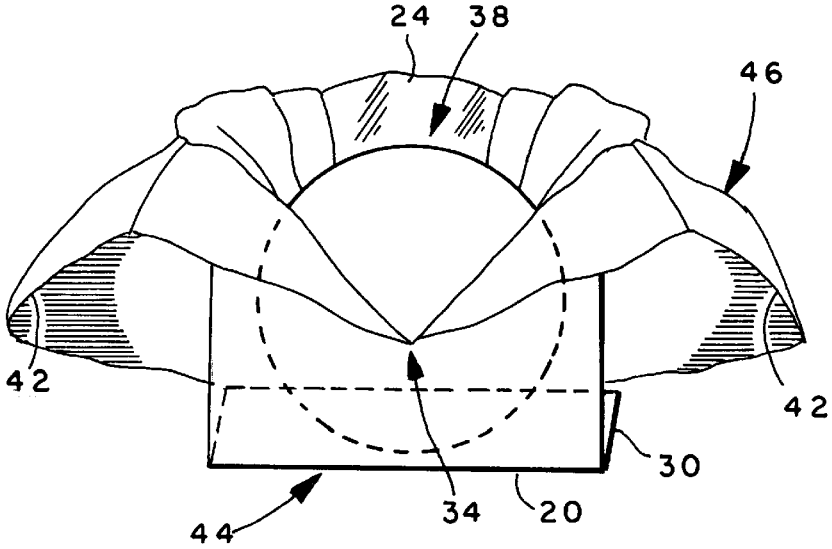
FIG. 5 illustrates the bag transformed to provide a pouch for the food product and an outwardly and downwardly extending skirt thereabout.
Figure 5:
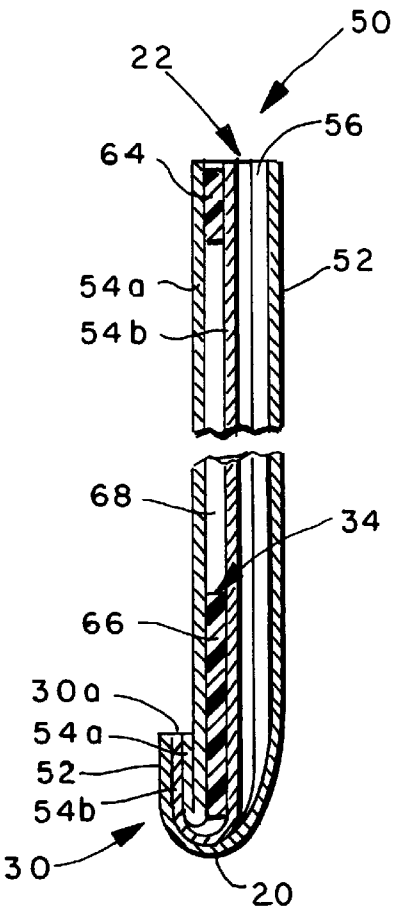
Figure 6:
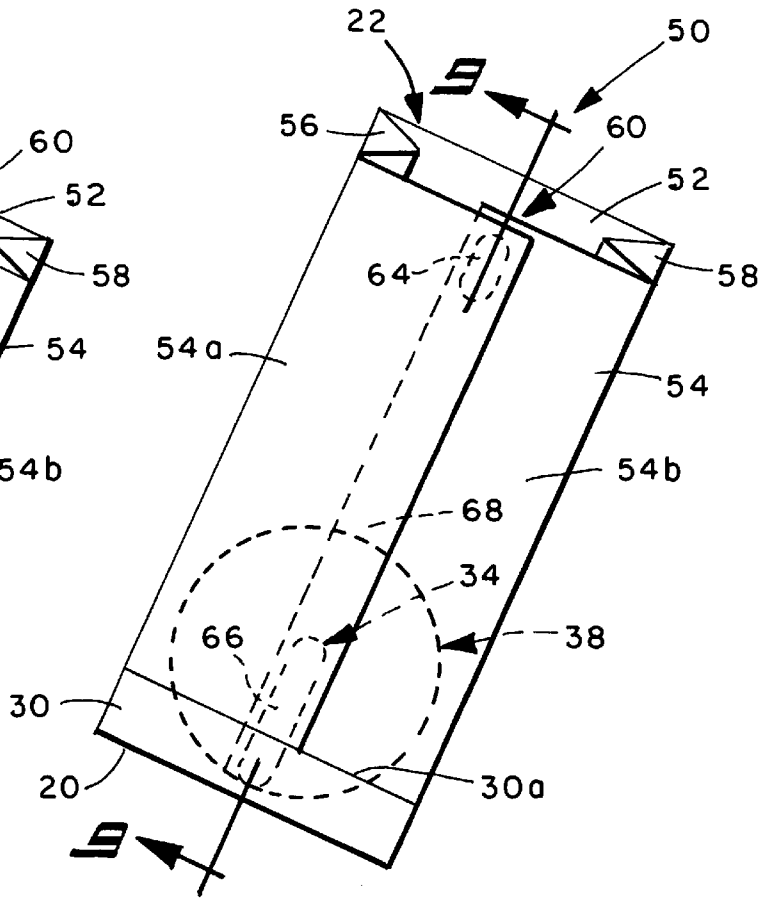

In the embodiment illustrated in FIGS. 1–5 of the drawing, the arrangement for providing an opening through the wall of the bag in the manner and for the purpose described above includes a line 32 in back wall 14 of bag 10 extending from top end 22 of the bag to a location 34 spaced above bottom end 20 of the bag and denoting a line of severance for opening the wall and providing the pouch and skirt described above. Preferably, line 32 is a line of weakness which can be continuous or a line of perforations through wall 14 such as would be defined by providing line 32 with slits 36 as shown in FIGS. 1 and 2. Preferably, line 32 is generally centrally between the sides of back wall 14. As will be appreciated from FIGS. 2 and 3 of the drawing, bag 10 is adapted to receive an edible food product 38 such as a hamburger which is introduced into the bag through open top 22. The upper end of bag 10 is then adapted to be folded downwardly to form a flap 40 by which the bag is temporarily closed for packaging the food product therein. When the consumer desires to eat the food product, he or she unfolds flap 40 and severs back wall 14 along line 32 down to location 34. As shown in FIG. 4, such severing of back wall 14 separates the latter into wall portions 14*a* and 14*b* having inner edges 42 formed by severing the back wall along line 32. Such severing of the back wall downwardly to location 34 provides a peripherally closed pouch 44 below location 34 and defined by corresponding portions of front wall 12, back wall 14 and side walls 16 and 18 of the bag. As shown in FIG. 5, the portions of the bag walls above location 34 are adapted to be folded outwardly and downwardly relative to pouch 44 and location 34 so as to expose food product 38 for eating and to provide a skirt portion 46 surrounding pouch 44. As will be appreciated from FIG. 5, a consumer can grasp the lower portion of food product 38 in pouch 44 so as to support the food product while eating the same, and skirt 46 extends outwardly over the consumer's hand. Accordingly, any liquids and/or juices exuded from food product 38 either prior to or during the eating thereof will either flow into and be retained in pouch 44 or will drop onto and be deflected outwardly away from the consumer's hand by skirt 46.

Figure 6:
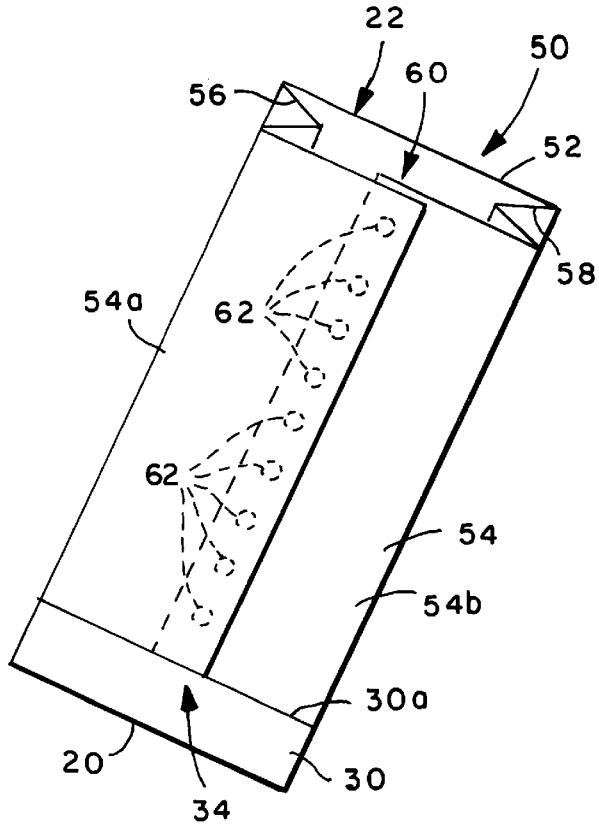
FIG. 6 is a perspective view of another embodiment of a bag in accordance with the present invention.

FIG. 6 illustrates a bag 50 in accordance with the present invention and which includes a modification of the arrangement disclosed in FIGS. 2–5 for providing an opening into the bag from the top end 22 thereof to location 34 spaced from bottom 20 of the bag. In this embodiment, bag 50 comprises a unitary sheet of flexible material, such as waxed kraft paper, which is folded to provide a front wall 52, a back wall 54, and pleated side walls 56 and 58. As in the earlier embodiment, bag 50 includes a flap 30 at the bottom end thereof by which the bag is closed and, in this embodiment, flap 30 is folded upwardly to overlie rear wall 54 and is adhesively bonded thereto. Rear wall 54 includes wall panels 54*a* and 54*b* which overlap one another generally centrally between the sides of the bag to provide a seam 60 extending from top end 22 to location 34 which, as will be appreciated from the foregoing description of flap 30, is defined by the upper edge 30*a* thereof. As will likewise be appreciated from the latter description of flap 30, the latter in the embodiment of FIGS. 1–5 could be folded to overlie back wall 14, whereby location 34 could be provided by the top edge of the flap. The overlapping portions of wall panels 54*a* and 54*b* are bonded to one another by a peelable self-adhesive 62 therebetween which may be in a continuous line along the seam or in spaced areas therealong as indicated in FIG. 6. A self-adhesive, as is well known, is capable of bonding the overlapping wall portions together in a manner which allows the overlapped portions to be peeled apart without tearing the paper material. While wall 54 is described herein as the back wall of the bag, it will be appreciated that it could be the front wall and, as mentioned hereinbefore, bag 50 could be constructed without pleated sidewalls 56 and 58, or to have a flat bottom as opposed to that provided by flap 30. Further, it will be appreciated that if flap 30 were folded to overlie front wall 52 in FIG. 6 rather than the back wall, the overlapping portions of seam 60 would extend to bottom 20 of the bag. In this instance, the portion of the seam between location 34 and bottom 20 of the bag could be defined by an adhesive bond therebetween which would not enable separation without tearing, or the bag could otherwise be provided with an arrangement for limiting the opening of the seam from going beyond location 34 in the direction toward bottom 20 of the bag.

Figure 7:
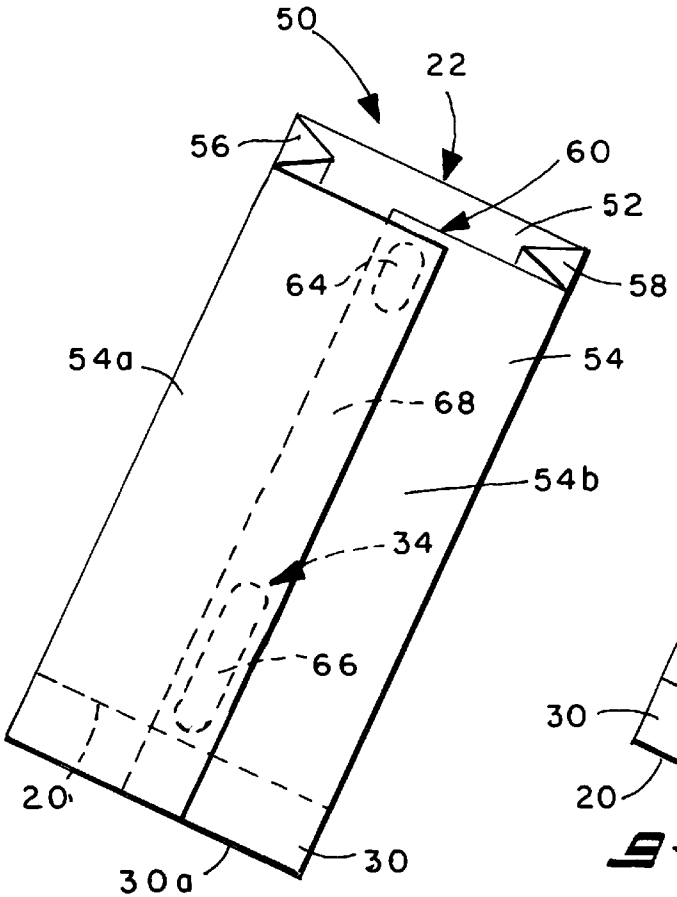
FIG. 7 is a perspective view of yet another embodiment of a bag in accordance with the present inventions and showing the bag prior to completing the closure at the bottom end thereof.

FIGS. 7–9 illustrate a modification of bag 50 shown in FIG. 6, whereby like numerals appear in FIGS. 7–9 to designate corresponding parts of bag 50. Referring first to FIG. 7, bag 50 is shown prior to the folding and adhesive bonding of bottom flap 30 to the outer sides of wall panels 54*a* and 54*b*. In connection with the forming of bag 50 to this point, the overlapping wall portions of panels 54*a* and 54*b* which provide seam 60 are joined together adjacent top 22 of the bag by an adhesive 64 and are joined together adjacent bottom 20 of the bag by a strip of adhesive 66 which extends upwardly to provide location 34 which, when flap 30 is folded and bonded to wall panels 54*a* and 54*b* as shown in FIG. 8, is spaced above bottom 20 of the bag. As will be best appreciated from FIG. 9, the overlapping wall portions are joined by adhesive 64 in a first area adjacent top 22 of the bag, are unjoined in a second area 68 between adhesive 64 and location 34 and are joined by adhesive 66 in a third area between location 34 and bottom 20 of the bag. While not shown for purposes of clarity, it will be appreciated that, in the folded configuration shown in FIG. 9, the overlapped portions of wall panels 54*a* and 54*b* and wall 52 which provide bottom flap 30 of the bag are adhesively bonded to one another. Preferably, the adhesive providing the latter bond does not enable separation of the bag material without tearing and, preferably, adhesive 66 is of the same bonding characteristic as that by which flap 30 is bonded to the wall panels. While adhesive 60 could also be of the same bonding characteristic, it is preferred that the latter adhesive be a peelable self-adhesive which, as mentioned above in connection with FIG. 6, is capable of bonding the upper ends of the overlapping wall portions together in a manner which allows separation thereof without tearing the paper material. Still further, while an adhesive 64 is preferred for joining the overlapping wall portions at the top end of the bag, it will be appreciated that the overlapping wall portions could be joined at least in the first area adjacent the top of the bag either at the time of manufacture or the time of insertion of a food product into the bag such as, for example, by stapling.

As will be appreciated from the embodiments described hereinabove, a food product 38 such as a hamburger is placed in bag 50 and top end 22 is folded over or downwardly to form a flap by which the bag is temporarily closed for packaging the food product therein. When the consumer desires to eat the food product, he or she introduces a finger or fingers into unjoined area 68 between the overlapped wall portions of panels 54*a* and 54*b* and moves the finger or fingers upwardly therein to separate the overlapping wall portions in the area of adhesive 64. This opens wall 54 of the bag down to location 34 and, as in the earlier embodiments, wall panels 54*a* and 54*b* and wall 52 of the bag below location 34 define a closed pouch for supporting the food product, and the wall panels and wall 52 above location 34 are folded outwardly and downwardly about the pouch to expose the food product for eating and to provide a skirt surrounding the pouch and covering the hand of the consumer which is supporting the food product in the pouch.

By way of example, in a bag structured as shown in FIGS. 7–9 which is about 9-½ inches long and 6 inches wide with a ⅞" overlap providing seam 60, adhesive 64 is about ½" to ¾" square and adhesive 66 is about ½" to ¾" wide and extends upwardly about 3-½ inches to location 34 from bottom 20 of the bag which leaves an open area 68 of about 5-¼ to 5-½ inches along seam 60.

While considerable emphasis has been placed herein on the embodiments of the invention illustrated and described, it will be appreciated that other embodiments can readily be devised and that the disclosed embodiments can be readily modified without departing from the principles of the invention. Accordingly, it is to be distinctly understood that the foregoing descriptive matter is to be interpreted merely as illustrative of the present invention and not as a limitation.

Having thus described the invention, it is so claimed:

1. A bag for packaging an edible food product and supporting the food product for eating, said bag having top and bottom ends and comprising walls of flexible material between said ends, said bottom end being closed and said top end being open, said walls including a pair of opposed wall panels having integrally interconnected, unbonded parallel side edges between said top and bottom ends, means between said top end and a location spaced from said bottom end for providing an opening through one of said wall panels along a single line from said top end to said location and being the only means for providing an opening through said walls, said location being closer to said bottom end then to said top end, said walls below and laterally of said location thereby defining a closed pouch below said location for supporting a food product, and said walls above said location being foldable outwardly and downwardly about said pouch to expose said food product and provide an uninterrupted skirt about said pouch, said means for providing an opening including a line of weakness in said one wall panel.

2. A bag according to claim 1, wherein said line of weakness includes perforations through said flexible material.

3. A bag according to claim 1, wherein said flexible material is opaque and at least a portion of the other of said wall panels is transparent.

4. A bag according to claim 1, wherein said flexible material is paper and at least a portion of the other of said wall panels includes a window of transparent plastic material.

5. A bag according to claim 4, wherein said means for providing an opening includes perforations through said one of said panels.

6. A bag according to claim 1, wherein said pair of opposed wall panels have interconnected side edges between said top and bottom ends, said means for providing an opening being centrally between the side edges of said one panel.

7. A bag according to claim 6, wherein said line of weakness includes perforations through said one panel.

8. A bag according to claim 7, wherein said flexible material is opaque and at least a portion of the other of said wall panels is transparent.

9. A bag according to claim 8, wherein said flexible material is paper and at least a portion of the other of said wall panels includes a window of transparent plastic material.

10. A bag according to claim 6, wherein said means for providing an opening includes means for denoting a line of severance between said top end and said location.

11. A bag for packaging an edible food product and supporting the food product for eating, said bag having top and bottom ends and comprising walls of flexible material between said ends, said bottom end being closed and said top end being open, said walls including a pair of opposed wall panels having interconnected, parallel side edges between said top and bottom ends, means between said top end and a location spaced from said bottom end for providing an opening through one of said wall panels along a single line from said top end to said location and being the only means for providing an opening through said walls, said walls below and laterally of said location thereby defining a closed pouch below said location for supporting a food product, said walls above said location being foldable outwardly and downwardly about said pouch to expose said food product and provide an uninterrupted skirt about said pouch, said pair of opposed wall panels having interconnected side edges between said top and bottom ends, said means for providing an opening being centrally between the side edges of said one panel, said one panel including overlapping wall portions extending from said top end toward said bottom end, and said means for providing an opening including a self-adhesive bond between said overlapping wall portions between said top and said location.

12. A bag for packaging an edible food product and supporting the food product for eating, said bag having top and bottom ends and comprising walls of flexible material between said ends, said bottom end being closed and said top end being open, said walls including a pair of opposed wall panels having interconnected, parallel side edges between said top and bottom ends, means between said top end and a location spaced from said bottom end for providing an opening through one of said wall panels along a single line from said top end to said location and being the only means for providing an opening through said walls, said walls below and laterally of said location thereby defining a closed pouch below said location for supporting a food product, said walls above said location being foldable outwardly and downwardly about said pouch to expose said food product and provide an uninterrupted skirt about said pouch, said walls including overlapping wall portions extending from said top end toward said bottom end, and said means for providing an opening including a self-adhesive bond between said overlapping wall portions between said top and said location.

13. A bag for packaging an edible food product and supporting the food product for eating, said bag having top and bottom ends and comprising walls of flexible material between said ends, said bottom end being closed and said top end being open, said walls including a pair of opposed wall panels having integrally interconnected, unbonded parallel side edges between said top and bottom ends, means between said top end and a location spaced from said bottom end for providing an opening through one of said wall panels along a single line from said top end to said location and being the only means for providing an opening through said walls, said location being closer to said bottom end then to said top end, said walls below and laterally of said location thereby defining a closed pouch below said location for supporting a food product, and said walls above said location being foldable outwardly and downwardly about said pouch to expose said food product and provide an uninterrupted skirt about said pouch, said means for providing an opening including means for denoting a line of severance between said top end and said location.

14. A bag for packaging an edible food product and supporting the food product for eating, said bag having top and bottom ends and comprising a pair of walls of flexible material having interconnected side edges between said top and bottom ends, said bottom end being closed and said top end being open, one of said walls including a pair of wall panels having overlapping wall portions between said top and bottom ends, said wall portions being joined together in a first area adjacent said top end, unjoined in a second area between said first area and a location spaced above said bottom end, and joined together in a third area between said location and said bottom end, said wall panels and the other of said walls below and laterally of said location defining a closed pouch below said location for supporting a food product, and said wall panels being separable in said first area for said wall panels and said other wall above said location to be foldable outwardly and downwardly about said pouch to expose said food product and provide a skirt about said pouch.

15. A bag according to claim 14, wherein said overlapping wall portions are joined together in said first and third areas by an adhesive bond therebetween.

16. A bag according to claim 14, wherein said flexible material is paper.

17. A bag according to claim 14, wherein said flexible material is opaque.

18. A bag according to claim 14, wherein said overlapping wall portions are joined together in said first area by an adhesive bond therebetween.

19. A bag according to claim 18, wherein the adhesive of said bond in said first area is a peelable self-adhesive material.

20. A bag according to claim 14, wherein said wall portions overlap centrally between the side edges.

21. A bag according to claim 14, wherein said flexible material is opaque and at least a portion of the other of said wall panels is transparent.

22. A bag according to claim 14, wherein said flexible material is paper and at least a portion of the other of said wall panels includes a window of transparent plastic material.

23. A bag according to claim 14, wherein said flexible material is paper and said overlapping wall portions are joined together in said first and third areas by an adhesive bond therebetween.

24. A bag according to claim 22, wherein the adhesive of said bond in said first area is a peelable self-adhesive material.

25. A bag according to claim 14, wherein said wall portions overlap centrally between said side edges and are joined together in said first area by an adhesive bond therebetween.

26. A bag according to claim 25, wherein said wall portions are joined together in said third area by an adhesive bond therebetween.

27. A bag according to claim 26, wherein the adhesive of said bond in said first area is a peelable self-adhesive material.

* * * * *